US007374072B2

(12) United States Patent
Irwin

(10) Patent No.: US 7,374,072 B2
(45) Date of Patent: May 20, 2008

(54) SLIDE ADJUSTABLE ASSEMBLY FOR MONITORING WIDTHWISE TRAVEL OF AN UNCOILING STEEL BAND THROUGH A FEEDER SYSTEM ASSOCIATED WITH A PROGRESSIVE DIE

(75) Inventor: Richard L. Irwin, Sterling Heights, MI (US)

(73) Assignee: BAE Industries, Inc., Centerline, MI (US)

( * ) Notice: Subject to any disclaimer, the term of this patent is extended or adjusted under 35 U.S.C. 154(b) by 512 days.

(21) Appl. No.: 10/984,296

(22) Filed: Nov. 9, 2004

(65) Prior Publication Data

US 2006/0097023 A1 May 11, 2006

(51) Int. Cl.
*B65H 26/00* (2006.01)
*B65H 43/00* (2006.01)

(52) U.S. Cl. ..... 226/21; 226/17; 226/20; 226/24

(58) Field of Classification Search ..... 226/10, 226/17, 20, 21, 24, 33, 38, 45
See application file for complete search history.

(56) References Cited

U.S. PATENT DOCUMENTS 3,368,665 A * 2/1968 Jinkins ..... 198/806
3,368,726 A * 2/1968 Funk et al. ..... 226/17
3,973,446 A * 8/1976 Vasilantone ..... 474/107
4,196,803 A * 4/1980 Lovett ..... 198/806
4,397,538 A * 8/1983 Castelli et al. ..... 399/165
4,421,228 A * 12/1983 Marsiglio et al. ..... 198/814
4,468,262 A 8/1984 Kaneda et al. ..... 148/156
4,633,693 A 1/1987 Tahara et al. ..... 72/8
5,004,173 A 4/1991 Kawai ..... 242/57
5,284,284 A 2/1994 Narishima et al. ..... 226/3
5,397,043 A * 3/1995 Blanding ..... 226/21
5,419,509 A * 5/1995 Krayenhagen ..... 242/419
5,485,945 A 1/1996 Linsenbardt et al. ..... 226/10
5,554,262 A * 9/1996 Turner ..... 162/198
5,722,279 A 3/1998 Ogawa et al. ..... 72/11.4
5,833,106 A * 11/1998 Harris ..... 226/17

(Continued)

FOREIGN PATENT DOCUMENTS

EP 0086270 B1 2/1986

(Continued)

*Primary Examiner*—Evan Langdon
(74) *Attorney, Agent, or Firm*—Gifford, Krass, Sprinkle, Anderson & Citkowski, P.C.

(57) ABSTRACT

An assembly for ensuring a correct lateral positioning of an elongated material conveyed along a feeder system and prior to a forming operation. The elongated material is fed from such as an unreeling coil and includes first and second lateral edges. First and second bodies are located along the feeder system and in communication with at least one of the lateral edges associated with the elongated material. Each of the bodies includes a fixed component secured to a rail extending laterally above the feeder system. A laterally displaceable component is biasingly secured to the fixed component and includes a roller in communication with a selected lateral edge of the elongated material. The bodies are laterally displaced, upon misalignment of the elongated material relative to the biasingly engaged roller. A sensor associated with each of the bodies causes an alarm signal to be issued to a processor, indicating the misalignment condition.

11 Claims, 4 Drawing Sheets

U.S. PATENT DOCUMENTS

| | | | | |
|---|---|---|---|---|
| 5,833,171 | A * | 11/1998 | Harris | 242/615.1 |
| 6,450,383 | B2 * | 9/2002 | Crowley et al. | 226/31 |
| 6,843,444 | B2 * | 1/2005 | Wood | 242/534.1 |
| 7,055,726 | B2 * | 6/2006 | Satoh et al. | 226/20 |
| 2003/0000988 | A1 * | 1/2003 | Ruhland et al. | 226/20 |
| 2004/0026474 | A1 * | 2/2004 | Yeo et al. | 226/3 |

FOREIGN PATENT DOCUMENTS

| | | |
|---|---|---|
| JP | 55149030 | 11/1980 |
| JP | 59042120 | 3/1984 |
| JP | 2000254721 | 9/2000 |

* cited by examiner

SLIDE ADJUSTABLE ASSEMBLY FOR MONITORING WIDTHWISE TRAVEL OF AN UNCOILING STEEL BAND THROUGH A FEEDER SYSTEM ASSOCIATED WITH A PROGRESSIVE DIE

BACKGROUND OF THE INVENTION

1. Field of the Invention

The present invention relates generally to alarm and shutdown mechanisms in use with progressive die machines and the like. In particular, the present invention discloses a slide adjustable assembly, typically mounted at both of opposing side edges of a feeder system and corresponding in placement with a widthwise feed direction of an elongated band, such as of steel, within the feeder system. The slide assembly detects lateral misalignment of the traveling steel band, such as is progressively unwound from a large coil, and warns an operator and/or automatically shuts down a progressive die operation, in order to prevent the incidence of scrap resulting from incorrect pre-positioning of the steel within the die.

2. Description of the Prior Art

The prior art is documented with examples of apparatuses for determining misalignment of a workpiece being fed into a machine. Among these in particular are mechanisms for monitoring a correct feed of an elongated, or strip, article into a designated type of bending, stamping, forming or other conventional machinery.

Ogawa, U.S. Pat. No. 5,722,279, teaches a control method for strip travel during a rolling process. Of note, a lateral position measuring device is disclosed and which detects the lateral position of the rolled work. The lateral position of the rolled work at the position of the rolled work tension measuring device is detected directly or estimated from an output of the lateral position measuring device.

Linsenbardt, U.S. Pat. No. 5,485,945, teaches a billet deforming (opening) apparatus positioned prior to a die. The metal from each billet merges in the die opening and exits in the form of a slit tube. The tube is then opened and flattened to form a flat strip by advancing the slit tube over a forming member having a progressively increasing width. An alignment system maintains the tube in a centered position and includes a light source disposed within the tube and two arrays of photo transistors arranged to receive light from the light source. Of note, Linsenbardt teaches that the amount of light sensed by each array is a function of the position of the slit in the tube relative to a desired position. Any difference noted results in a steering roll which is in contact with the outer surface of the tube, and which is pivoted in a direction which will bring the tube back into alignment.

Narishima, U.S. Pat. No. 5,284,284, teaches a method of guiding a strip of material, e.g. steel, between a pair of spaced guide members, through pinch rolls and optionally on to a winder to be coiled. When the strip passes the upstream end of the guide members, the members are moved inwardly to narrow the gap between them to a predetermined size greater than the width of the strip and, when the leading end of the strip enters the pinch rolls, in a further stage, the members move together to further narrow the gap between them. Of note, the second stage may be governed in response to the output from sensors which detect the width of the strip and the position of its center. In this manner, the positions of the guide members may be continuously varied to accommodate the varying width of the strip and to produce a coil having a uniformly wound portion affording a flat surface.

Kawai, U.S. Pat. No. 5,004,173, teaches a method for controlling a web feeding device comprising a pair of center blocks, disposed upon predetermined movable members so as to oppose each other with their axis being aligned, to perform loading and unloading of a web roll by moving closer to or farther away from each other. A lifter is disposed adjacent to the movable members and vertically driven so as to elevate the web roll loaded thereon. Of note, a sensor detects alignment of the pair of center blocks with the core tube of the web roll, the alignment of which is detected by the sensor so as to instantaneously stop the ascending motion of the lifter.

Japanese Publication JP2000254721 teaches a device with conveying table rollers for conveying a steel sheet in a longitudinal direction. Included is a means for moving the steel sheet in a width direction and which includes movable stoppers installed in the longitudinal direction of the steel sheet and movable in the width direction by individual controllers.

Japanese Publication JP55149030 teaches a strip plate detection device which includes gap sensors for shape detection. Of note, the roller and respective sensors change according to the distribution of the tension in the width direction and the detection signals of the spacing changes are input from the sensors to an operator, by which the true tension distribution value after the correction of the deflection of a shaft is obtained.

Finally, EP 0 086 270 to Krauth teaches a device for controlling the run-off of a continuously drawn web, such as in particular a web of sheeting, textile fabric, or knitted fabric with a fluctuating web width. Krauth includes a turning mechanism, which may be driven with a movement correcting the run-off and with a signal emitting sensor located at each lateral edge. The sensors are mounted at their respective interspacing for synchronous adjustment transversely to the direction of the web run-off. A change in distance between the sensors results is indicated by signals emitted by each, the superimposition of which results in a corrected signal being issued to the (drive) turning mechanism.

SUMMARY OF THE PRESENT INVENTION

The present invention discloses a slide assembly, typically including the provision of first and second laterally positioned bodies, mounted at both of opposing side edges of a feeder system, and which corresponds in placement with a widthwise feed direction of an elongated steel coil band conveyed by the feeder system. In particular, the slide assembly operates to detect a lateral misalignment of the traveling steel band, such as during it being progressively unwound from a large coil and prior to be fed into a progressive die operation or other forming operation associated with the elongated band of material.

In a preferred embodiment, a rail is adapted to extend laterally above the feeder system, the first and second bodies being adjustably secured to locations along the rail corresponding to the edges of the feeder system and associated steel band. A roller corresponding to each body is biasingly applied against an associated lateral edge of the conveyed steel band.

Upon occurrence of a misalignment condition, exhibited by the lateral edges of the steel band traveling relative to the rollers, a sensor slaved to each of the slide bodies is tripped, resulting in a warning signal being sent to issued to a sensor. A processor, in communication with the sensor, is notified of the misalignment condition and, as a result, activates an alarm and, alternatively or additionally, automatically shuts down the die operation in order to prevent the incidence of scrap resulting from incorrect pre-positioning of the steel within the die. The sensor mechanism may also be utilized with the processor in order to shut down the machine, this typically occurring upon a trailing edge of the steel band passing the rollers, causing them to be inwardly displaced.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
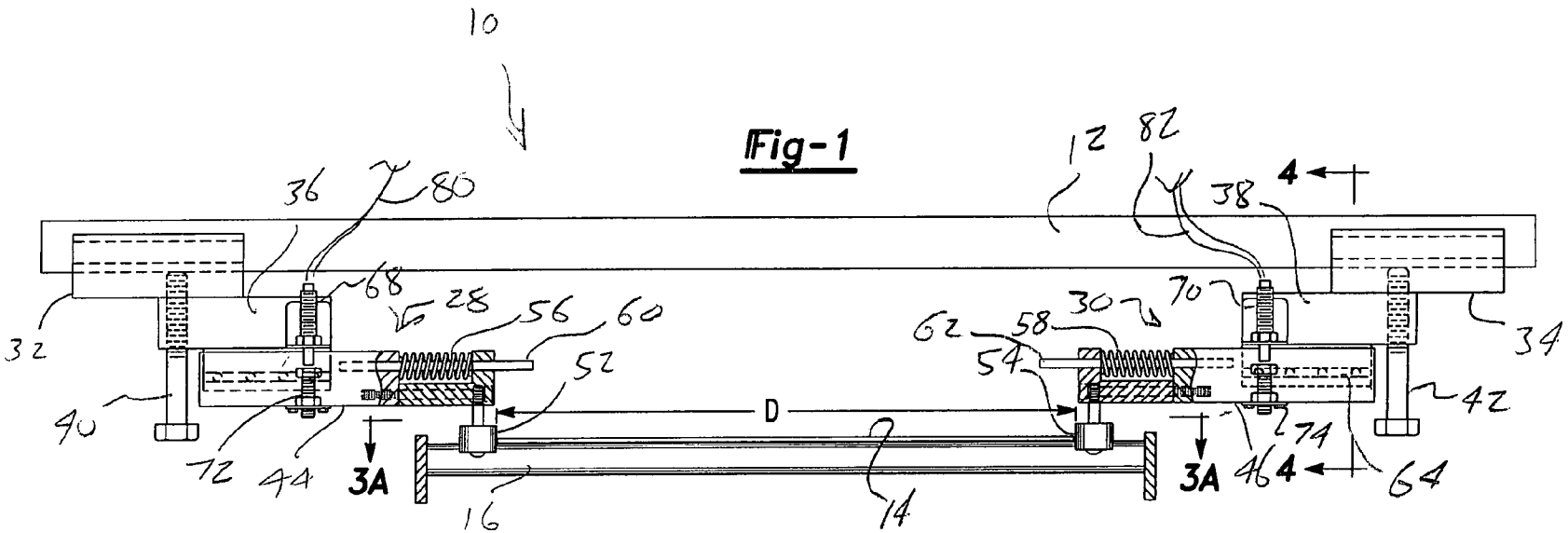
FIG. 1 is a side view illustration of a slide adjustable assembly in use with a dovetail slide rail for monitoring a widthwise travel of an uncoiling steel band through a feeder system associated with a subsequent forming operation, and according to the present invention.
Figure 2:
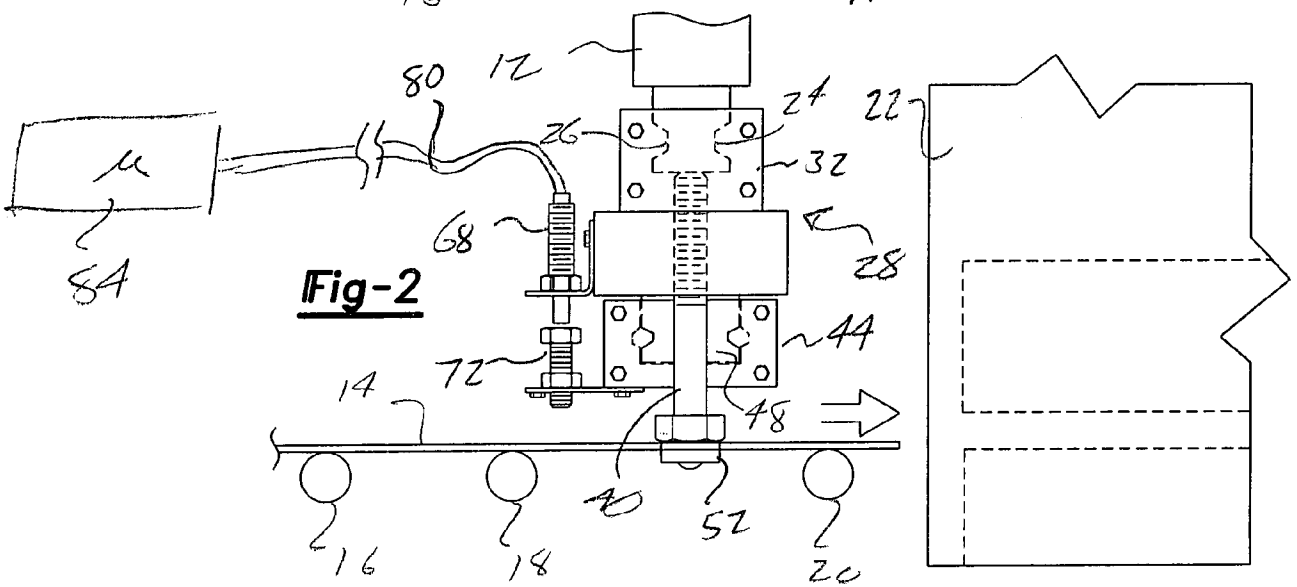
FIG. 2 is a side view illustrating a selected slide adjustable assembly in mounting arrangement relative to the feeder conveyed band of material and prior to insertion into a succeeding die forming operation.

Referring to FIGS. 1 and 2, a side view illustration is presented at 10 of a slide adjustable assembly in use with a dovetail slide rail 12, in particular for monitoring a widthwise travel of an uncoiling steel band 14 through a feeder system (such as referenced by rollers 16, 18 and 20). The feeder system is associated with a subsequent forming operation, such as representatively illustrated in FIG. 2 at 22, and is understood to include such any type of die forming, stamping, rolling or forming operation which in particular requires a correct pre-positioning of an elongated band (typically precut) of workpiece material.

In a preferred embodiment, the forming operation 22 is a progressive die operation which relies upon precise lateral alignment of the band of steel 14, and such as which is unreeled from a roll (not shown) of such material. It is also understood that other types of elongated feed material, such as including other types of metals, plastics and the like, can be utilized with the slide adjustable assembly and it is further envisioned that other die forming, bending, rolling or other forming operation can be employed in cooperation with the conveyed material.

Referring again to FIGS. 1 and 2, the rail 12 exhibits a dovetail configuration which includes inwardly recessed and elongate extending sides 24 and 26. A pair of bodies, see as generally referenced at 28 and 30, are mounted at laterally specified locations to the rail 12.

Figure 4:
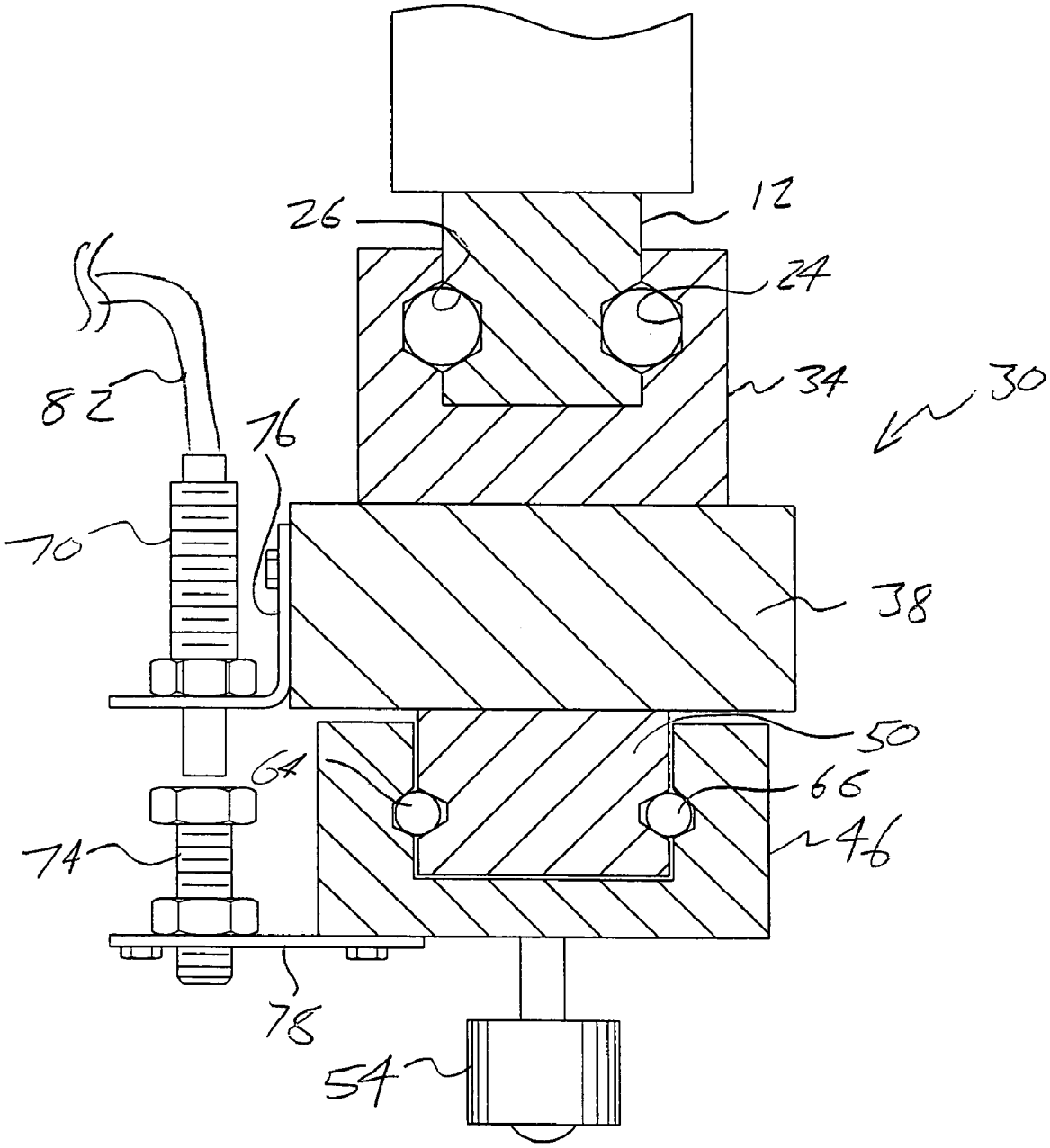
FIG. 4 is a further cutaway view, taken along line 4-4 of FIG. 1, and illustrating the components of a selected slide adjustable assembly, including the dovetail rail mounted slide, spacer block, and actuating slide including roller guide as well as proximity sensor and target.

As best shown in the side view of FIG. 2 and the further cutaway of FIG. 4, each of the bodies 28 and 30 includes an uppermost slide assembly, see respectively at 32 for body 28 and at 34 for body 30. Each of the uppermost slide assemblies includes an interiorly extending and mating dovetail configuration which allows for inward and outward lateral adjustment along the axial extending length of the rail 12.

Each of the slide assembly bodies 28 and 30 further includes an intermediate spacer block, see at 36 for body 28 and at 38 for body 30. Stop adjustment screws, see at 40 and 42, extend through aligning and apertured locations established between the spacer blocks 36 and 38 and the upper slide assemblies 32 and 34, the adjustment screws 40 and 42 being tightened at desired lateral locations to secure the bodies 28 and 30 in place along the rail 12.

A lowermost component associated with each of the bodies 28 and 30 is illustrated at 44 with reference to body 28 and at 46 with reference to body 30. Each of the components 44 and 46 define a substantial "U" shape in cross section and are designed to laterally displace relative to inner positioned and fixed elements, see at 48 and 50, which are in turn fixed to underside locations of the spacer blocks 36 and 38.

Each of the laterally displaceable components 44 and 46 includes a downwardly extending guide roller 52 and 54. Coil springs 56 and 58 are mounted about associated guide pins 60 and 62, in turn operably interconnecting the fixed and laterally displaceable components and in a manner such that the rollers 52 and 54 are inwardly biasingly engaged against the side edges of the traversing band of material 14, and as is referenced by the distance "D".

In the preferred embodiment, each of the substantially "U" shaped portions are biasingly mounted by the spring and guide pin to the inner and substantially rectangular shaped fixed portions, and in particular such that the associated rollers are allowed to laterally displace in either inward or outward direction and responsive to any type of lateral misalignment of the lateral edges of the elongated feed material 14. As best illustrated in the enlarged cutaway view of FIG. 4, the selected outer displaceable component 46 is displaceably secured to the inner fixed element 50 further through the positioning of pins 64 and 66, these cooperating with the coil spring 58 and guide pin 62 in order to effectuate the inward/outward lateral displacement of the roller 54 and associated component 46. The structure and operation of the corresponding slide components of the first body 28 is identical to that illustrated and described with reference to FIG. 4 and such that a repetitive description is unnecessary.

A sensor assembly is associated with each of the slide assemblies and further includes an illuminating portion, see at 68 and 70, and an opposing target portion, at 72 and 74, respectively. In the preferred embodiment illustrated, the illuminating sensor portions 68 and 70 are secured by brackets, see for example at 76 in FIG. 4, to a side of the spacer blocks 36 and 38, these forming portions of the fixed component for each of the slide assembly bodies 28 and 30. The target portions 72 and 74 are likewise mounted by brackets, see for example at 78 in FIG. 4 extending from an underside of the "U" shaped and laterally traversable component 46.

Each of the sensor assemblies is typically provided as some form of optical/light sensor which determines when an illuminating light source (such as a laser or other focused intensity beam) is applied by the illuminating portions 68 and 70 to the target portions 72 and 74. A communication line, see at 80 and 82, extends from each of the illuminating portions 68 and 70 and serves the dual purpose of providing an illuminating capacity to the portions 68 and 70 (such as a fiber optical or other powered illuminating supply), as well as additionally responding to an offset of a selected target portion 72 and 74; this further typically results in a signal being issued along the specified communication line 80 or 82 to a remotely located microprocessor (see at 84 in FIG. 2) and instructing either or both of an alarm and shutdown of the associated die operation 22.

Figure 3A:
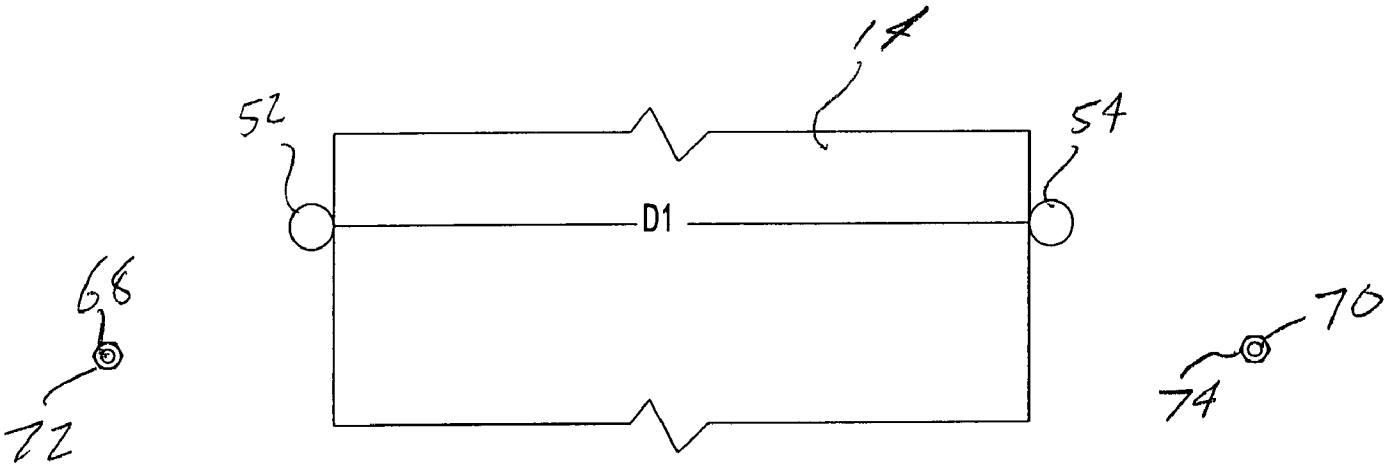
FIG. 3A is a first cutaway view taken along line 3A-3A of FIG. 1 and illustrating the feeder conveyed band of material in an aligned position.
Figure 3B:
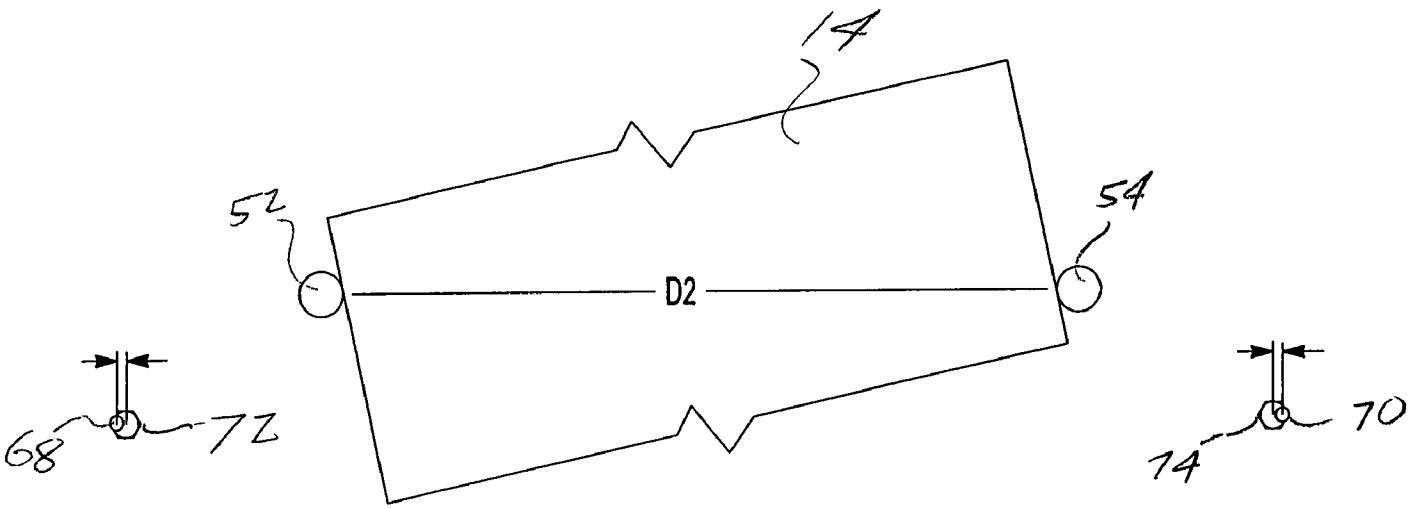
FIG. 3B is a similar illustration to that shown in FIG. 3A and showing a misalignment condition experienced by the laterally positioned slide assemblies.

For example, and referencing FIGS. 3A and 3B, first and second cutaway views illustrate the feeder conveyed band of material in both aligned and misaligned conditions experienced by the laterally positioned slide assemblies. In these illustrations the specified distance (identified in FIG. 3A as D1) corresponds to a correctly aligned material band 14 (such as again steel being unreeled from a coil or drum).

In FIG. 3B, the material 14 becomes laterally misaligned, resulting in the rollers 52 and 54 displacing, this in turn resulting in the slaved target portions 72 and 74 displacing away from the illuminating sensor portions and the material width distance D1 becoming D2, at which point the command is given to the microprocessor to issue an alarm and/or shutdown the die machine. It is further envisioned that, upon a trailing edge of the steel band 14 passing the pair of rollers 52 and 54, the same displace inwardly to automatically deactivate the machine.

Figure 5:
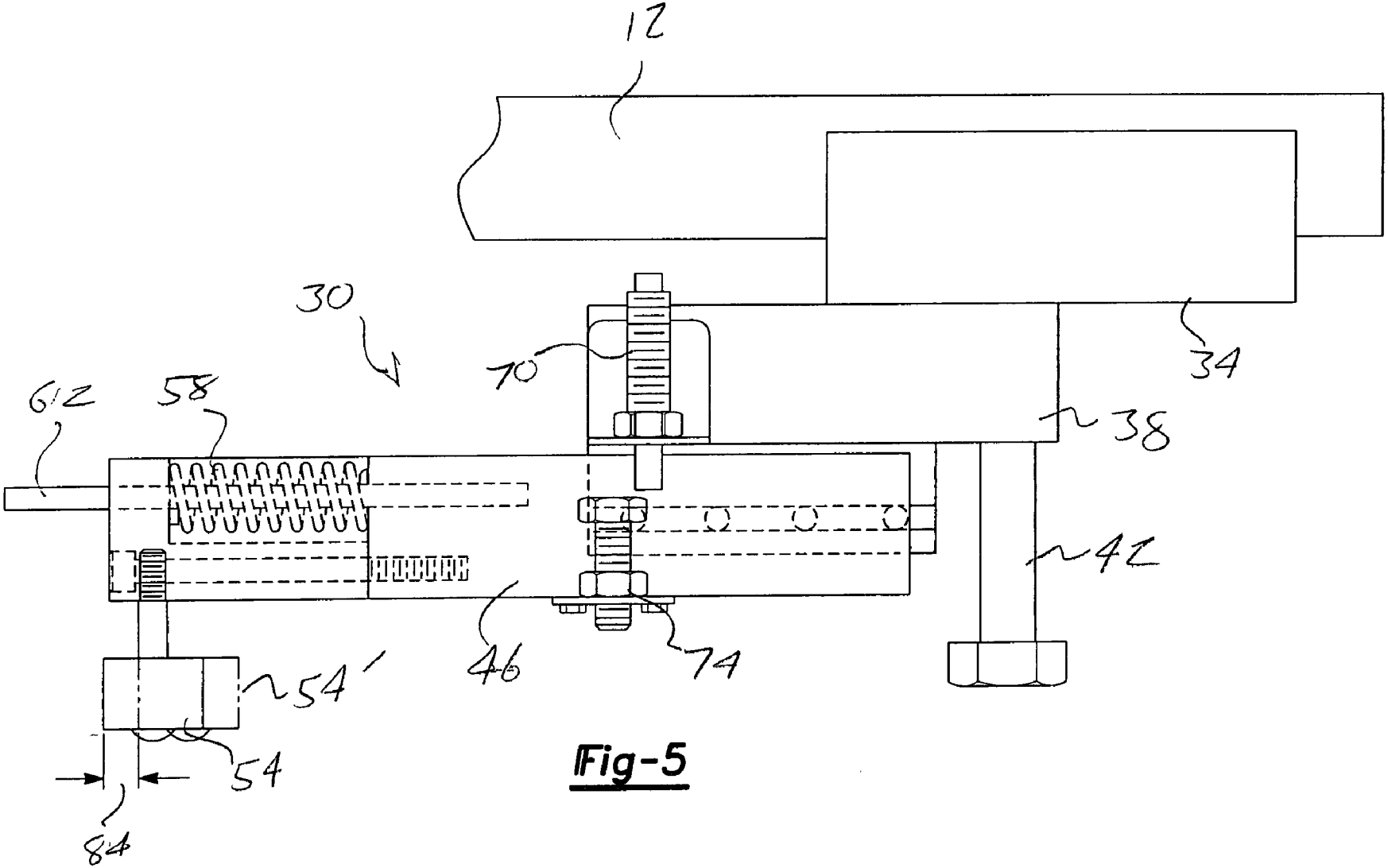
FIG. 5 is an enlarged sectional illustration of a slide assembly drawn from the illustration of FIG. 1 and further illustrating a range of lateral motion established between the actuating slide and spacer block according to the present invention.

Referring again to FIG. 5, an enlarged sectional illustration of a slide assembly is drawn from the illustration of FIG. 1 and further illustrating a range of lateral motion established between the actuating slide 46 and spacer block 38. In particular, an incremental distance 84 defines a minimum range of motion which is necessary to trip the associated sensor mechanism and to announce a misalignment condition.

Accordingly, the present invention allows for monitoring of a width of a coil of steel as it runs through a feeder system to a progressive die and is an effective way to control alignment and mis-hitting of the steel coil within the press. It is also envisioned that, in addition to the variant illustrated, other variants are contemplated including a single roller located along one laterally extending edge of the traversing steel band, as well as multiple pairs of slide assemblies located along the length of the feeder system.

Having described my invention, other and additional preferred embodiments will become apparent to those skilled in the art to which it pertains, without deviating from the scope of the appended claims.

I claim:

1. An assembly for ensuring a correct lateral positioning of an elongated material conveyed along a feeder system and prior to a forming operation, the elongated material including first and second lateral edges, said assembly comprising:

at least first and second bodies located along the feeder system and in communication with at least one of the lateral edges associated with the elongated material, a rail adapted to extend laterally above the feeder system, said first and second bodies being adjustably secured to said rail, said rail exhibiting a specified shape and size and exhibiting, in cross section, a dovetail configuration, each of said first and second bodies including an uppermost slide assembly matingly and adjustably secured to locations along said dovetail rail corresponding to the first and second lateral edges of the elongated material;

each of said bodies further comprising a fixed component including said uppermost slide assembly, a laterally displaceable component being mounted relative to said fixed component, said laterally displaceable component further comprising a roller in communication with a selected lateral edge of the elongated material, a coil spring mounted about a guide pin operably connecting said fixed and laterally displaceable components, said laterally displaceable component further comprising an outer and substantially "U" shaped portion biasingly mounted by said spring and guide pin to an inner and substantially rectangular shaped fixed portion; and said at least one body being laterally displaced, upon misalignment of the elongated material, a sensor associated with said body causing an alarm signal to be issued to a processor indicating said misalignment, said sensor further comprising an illuminating portion and an opposing target portion, a selected one of said illuminating and target portions being laterally displaceable upon movement of said roller relative to the associated elongated material edge to indicate said misalignment condition.

2. The assembly as described in claim 1, said feeder system further comprising a series of rollers upon which is supported the conveyed material.

3. The assembly as described in claim 1, said sensor further comprising an optical proximity sensor, a conduit extending from said sensor and, upon experiencing a misalignment condition, communicating said condition to an input associated with said processor.

4. The assembly as described in claim 1, said roller further comprising a mounting pin extending from said laterally displaceable component and being biasingly engaged against said selected material edge.

5. The assembly as described in claim 4, further comprising, upon a trailing edge of the elongated material passing said rollers, inward displacement of said rollers causing said processor to shut down said forming operation.

6. An assembly for ensuring a correct lateral positioning of an elongated material conveyed along a feeder system and prior to a forming operation, the elongated material including first and second lateral edges, said assembly comprising:

at least first and second bodies located along the feeder system and in communication with the lateral edges associated with the elongated material, a rail adapted to extend laterally above the feeder system, said first and second bodies being adjustably secured to said rail, said rail exhibiting a specified shape and size and exhibiting, in cross section, a dovetail configuration, each of said first and second bodies including an uppermost slide assembly matingly and adjustably secured to locations along said dovetail rail corresponding to the first and second lateral edges of the elongated material;

each of said bodies further comprising a fixed component including said uppermost slide assembly, a laterally displaceable component being mounted relative to said fixed component:

said laterally displaceable component further comprising a roller in communication with a selected lateral edge of the elongated material, a coil spring mounted about a guide pin operably connecting said fixed and laterally displaceable components;

said laterally displaceable component further comprising an outer and substantially "U" shaped portion biasingly mounted by said spring and guide pin to an inner and substantially rectangular shaped fixed portion;

said at least one body being laterally displaced, upon misalignment of the elongated material, a sensor associated with said body causing an alarm signal to be issued to a processor indicating said misalignment; and said sensor further comprising an illuminating portion and an opposing target portion, a selected one of said illuminating and target portions being laterally displaceable upon movement of said roller relative to the associated elongated material edge to indicate said misalignment condition.

7. The assembly as described in claim 6, said illuminating sensor portion secured to said fixed component, said target portion secured to said laterally displaceable component.

8. The assembly as described in claim 6, each of said bodies further comprising a spacer block mounted intermediate said uppermost slide assembly and said inner fixed portion.

9. The assembly as described in claim 8, further comprising a stop adjustment screw for securing said spacer block to said upper slide assembly.

10. The assembly as described in claim 8, the elongated material exhibiting a specified shape and size and further comprising an unreeling steel band.

11. The assembly as described in claim 8, further comprising a stop adjustment screw extending through aligning apertures established between said spacer block and said uppermost slide assembly, said adjustment screw defining an adjustment location along said slide rail.

* * * * *